US010184324B2

(12) United States Patent
Max

(10) Patent No.: US 10,184,324 B2
(45) Date of Patent: Jan. 22, 2019

(54) WELLBORE LINING FOR NATURAL GAS HYDRATE AND METHOD OF CONSTRUCTING A WELLBORE LINING FOR NATURAL GAS HYDRATE

(71) Applicant: MaxSystems LLC, Washington, DC (US)

(72) Inventor: Michael D. Max, Washington, DC (US)

(73) Assignee: MAXSYSTEMS, LLC, Washington, DC (US)

( * ) Notice: Subject to any disclaimer, the term of this patent is extended or adjusted under 35 U.S.C. 154(b) by 0 days.

(21) Appl. No.: 15/644,947

(22) Filed: Jul. 10, 2017

(65) Prior Publication Data

US 2018/0010425 A1 Jan. 11, 2018

Related U.S. Application Data

(60) Provisional application No. 62/360,501, filed on Jul. 11, 2016.

(51) Int. Cl.

| | |
|---|---|
| ***E21B 43/10*** | (2006.01) |
| ***E21B 33/14*** | (2006.01) |
| ***E21B 43/04*** | (2006.01) |
| ***E21B 43/08*** | (2006.01) |
| ***E21B 34/10*** | (2006.01) |

(52) U.S. Cl.

CPC ..... *E21B 43/101* (2013.01); *E21B 33/14* (2013.01); *E21B 34/106* (2013.01); *E21B 43/04* (2013.01); *E21B 43/084* (2013.01)

(58) Field of Classification Search

CPC ..... E21B 43/101; E21B 43/084; E21B 17/021

See application file for complete search history.

(56) References Cited

U.S. PATENT DOCUMENTS

| | | | | |
|---|---|---|---|---|
| 9,097,108 | B2 * | 8/2015 | Johnson | E21B 43/108 |
| 2006/0278396 | A1 * | 12/2006 | Sotomayor | E21B 43/305 166/313 |
| 2014/0238699 | A1 * | 8/2014 | Gette | E21B 33/04 166/387 |

* cited by examiner

*Primary Examiner* — Catherine Loikith

(74) *Attorney, Agent, or Firm* — Potomac Law Group, PLLC; Kenneth Fagin

(57) ABSTRACT

A wellbore lining system that puts liners into place immediately behind the drill head tool is used in drilling and for preparing natural gas hydrate (NGH) deposits for production of its natural gas. The system overcomes the requirement of setting casing from the wellhead, which controls well bore diameter with depth and allows for flexibility in well bore size at any depth. Wellbore liners stabilize the well walls by being very tightly fitting against bounding rocks and sediments, which overcomes the requirement for cementing, which commonly accompanies conventional well casing. In addition, liners can be emplaced with designed impermeability, permeability, and complex flow-through patterns so that production processes, such as sand flow, can be put in place as part of a liner section.

10 Claims, 3 Drawing Sheets

WELLBORE LINING FOR NATURAL GAS HYDRATE AND METHOD OF CONSTRUCTING A WELLBORE LINING FOR NATURAL GAS HYDRATE

CROSS-REFERENCE TO RELATED APPLICATIONS

This application claims the benefit of U.S. Provisional Application No. 62/360,501, filed Jul. 11, 2016, the entirety of which is incorporated herein by reference.

FIELD OF THE INVENTION

The present invention relates to oceanic natural gas hydrate conversion and recovery of hydrocarbon natural gas, and more particularly, relating to systems and methods of lining wellbores while drilling so that natural gas can be recovered efficiently and safely from natural gas hydrate.

BACKGROUND OF THE INVENTION

Natural gas hydrate (NGH) is physically unique among gas resources that occur in the deepwater environment of deep continental shelf areas and continental slopes. The physical nature and occurrence of NGH, the potential volumetric scale of the resource, well understood petroleum system, and other key parameters allow for exploration and production opportunities that do not apply to conventional deepwater gas deposits. These allow for relatively inexpensive adaptation of existing technologies in a less robust form and the development of new technologies and practices to be applied to NGH that will have a strong bearing on their commerciality.

NGH is a non-stoichiometric solid, crystalline material composed of water molecules forming cage structures that are predominantly occupied by hydrocarbon gas molecules. Methane is the dominant gas found in naturally occurring NGH, although higher density hydrocarbons such as ethane, propane, and butane, and non-hydrocarbon gas molecules, for instance such hydrogen sulfide, nitrogen, and carbon dioxide may be found as traces, can also occur in compound NGH. Herein, all types of natural gas hydrate are referred to as (NGH) to include all species for the sake of simplicity.

NGH forms spontaneously under the right combinations of pressure and temperature conditions when there is sufficient natural gas flux within a zone of NGH stability that extends downward from the seafloor to some depth determined by rising temperature. Concentrations of NGH occur in water depths of about 500 m and greater in the open ocean and shallower in Polar Regions. For example, the Nankai deposit, which lies about 200 m below the seabed at a water depth of about 1 km near the edge of the continental shelf SE of Tokyo Bay, Japan is currently the best example of a potentially commercializable NGH deposit. Large concentrations are controlled by geology and a large number of the concentrations may be large enough to constitute an economic natural gas resource. Because the projected amount of NGH in reservoir situations is very large, on the order of 43,000 trillion cubic feet of gas, even a relatively small fraction of the current estimate of gas-in-place means that NGH could constitute the largest recoverable natural gas resource on Earth.

Depressurization has proven as the NGH conversion technique and which was used during the first and successful Japanese technical production test near the edge of the continental shelf SE of Tokyo Bay, Japan. Use of this conversion technique enables a set of opportunities and new risks that drive technology development, particularly in the fields of drilling and production, exist because pressures in the NGH reservoir will be much lower than in conventional deposits and the geotechnical confinement will be much less physically secure. In addition, the strength of the reservoir will decrease with production of the NGH to a much greater extent than a conventional gas deposit as solid NGH is replaced by gas and water.

Oceanic NGH reservoirs are very unlike deepwater conventional reservoirs although they both occupy sediment porosity and displace water. Conventional gas traps are deeply buried and mechanically strong. NGH reservoirs occur in only partially consolidated marine sediment within no more than about 1 km from the seafloor. Conventional gas exists in its reservoir and flows to the wellhead at high pressures and temperatures. NGH deposits, in contrast, consist of solid crystalline NGH that when is converted to its constituent gas and water by depressurization, results in pressure in the producing well system that are lower than reservoir formation pressure and temperatures that are no higher than a few tens of degrees C.

Typical well casing of conventional vertical wells consists of a series of pipe sections joined together using screw, bayonet, or other connections. Casing sections are inserted down into the wellbore from or through the seafloor. A casing well string consists of a series of constant diameter sections that decreases in diameter with depth in a series of stages. This is because only a certain length of casing stage can be mechanically inserted into the well before drag from the bounding rocks or sediments effectively limit the depth of each section. Depths of sections vary based on the geological materials, the oversize of the well bore, and drag that can be caused by a number of factors such as, but not limited to, straightness of the well, the yielding character of the bounding materials, and insertion force available. Because the external surface of casing is not everywhere tight against the rock walls, cementing at intervals is used to fill the annular space between the casing and the rock wall. Cementing is meant to provide a very solid anchor to apparatus at the wellhead, such as the blowout preventer, and within the well to provide a tight seal between the casing and the rock that prevents movements of gas and liquids along the outer surface of the casing.

Production from the reservoir begins with the transfer of gas and unwanted materials such as water and solid particulates through permeable perforated intervals in casing within a reservoir pay zone. Flow control often involves the use of sand screens and gravel packs, which diminish the amount of sediment grains by slowing the flow, which reduces the carrying potential of gas and fluids migrating from the reservoir into the well.

While conventional well casing systems and methods are suitable for conventional gas deposits, they are not suitable for NGH deposits. Accordingly, there is a need for new well casing systems and methods that are suitable for use in the recovery of hydrocarbon gas from deepwater NGH deposits.

SUMMARY OF THE INVENTION

Embodiments of the present invention provided new well casing systems and methods that are suitable for recovery of hydrocarbon gas from natural gas hydrate deposits.

Embodiments of the present invention provide new well casing systems and methods that cost less than conventional well bore casing systems.

In certain embodiments, an active well bore lining system and method is provided where a wellbore is lined from the front or from just behind the wellbore after lining is delivered in a compressed form to the head of the well. Casing is not directly inserted from the wellhead except to be transported to the head of the well where it is affixed in place. Each section is fixed solidly into place just behind the drilling unit, extending the lining. Regardless of materials used or the manner of setting, these are all referred to as "wellbore liners", or more simply, "liners" to distinguish them as a group from conventional casing and its manner of insertion into a well.

Each liner can be set in an essentially solid manner against, or even bonded to the formation. This is very different from the looser fitting of drill casing and also different from larger diameter tunnel lining that is built forward from the head of a tunnel under construction but which must be further cemented to provide a seal with bounding rock and sediments.

Impermeable and permeable liners can be inserted during a single phase of drilling operations that combine the final state of exploration drilling and preparation for production. Impermeable liners are used where no fluid exchange with the surrounding materials is desired, and permeable liners are used where fluid exchange for gas production purposes is desired. Special liners can be used in pay sections to assist production.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in numerous ways. Also, it is to be understood that the phraseology and terminology employed herein are for descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The following drawings illustrate by way of example and are included to provide further understanding of the invention for illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Securing the physical integrity of a wellbore associated with hydrocarbon exploration and production is a concern of primary importance to keep the wellbore open during drilling operations, and to allow subsequent maintenance of well control during production. Rapid lining and stabilization of well bores is of particular importance in NGH drilling, which will occur in incompletely consolidated sediments with low mechanical strength. Because wellbore walls formed from partially consolidated sediments have a greater likelihood of sloughing into a wellbore than rock that usually forms the trap and reservoir for conventional gas deposits, it is important to place wellbore liners as near forward to the NGH drilling face as possible. Because the NGH liner system does not have to withstand the high temperatures and differential pressures of conventional production well bores, opportunity for a much less mechanically and materially strong wellbore liner system exists for production of natural gas from NGH.

Figure 1:
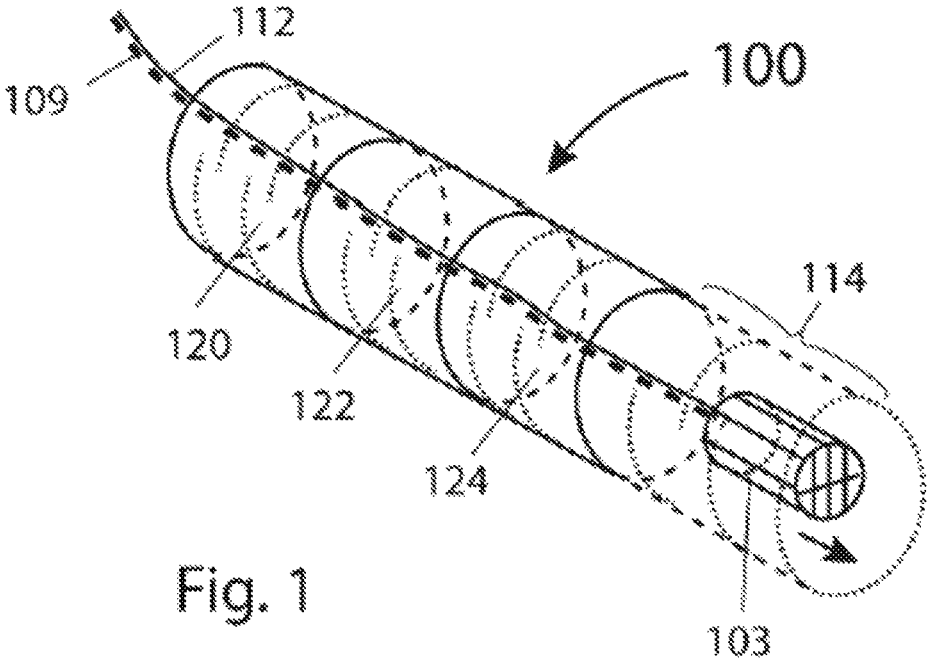
FIG. 1 is a diagrammatic representation of a well bore with liners being emplaced from the tip of the well just behind a bottom hole apparatus carrying drilling and lining-assistance technology, with FIG. 1*a* being a "bigger-picture" depiction to illustrate the overall context.

Active well bore lining methods and systems of the present invention strengthens and secures the well from the head, near the drilling face (FIG. 1). The well bore system 100 is termed an "active" system because it will be part of a new drilling technology system in which most of the activity that is used in the drilling and well lining is carried out at the head of the well. Robotization, automation, and miniaturization of electrically controlled mechanical systems also will be capable of some independent action rather than being controlled entirely from the wellhead or remotely. It is envisaged that all activity in the well will be supported and controlled from the seafloor at and near the wellhead.

Figure 1A:
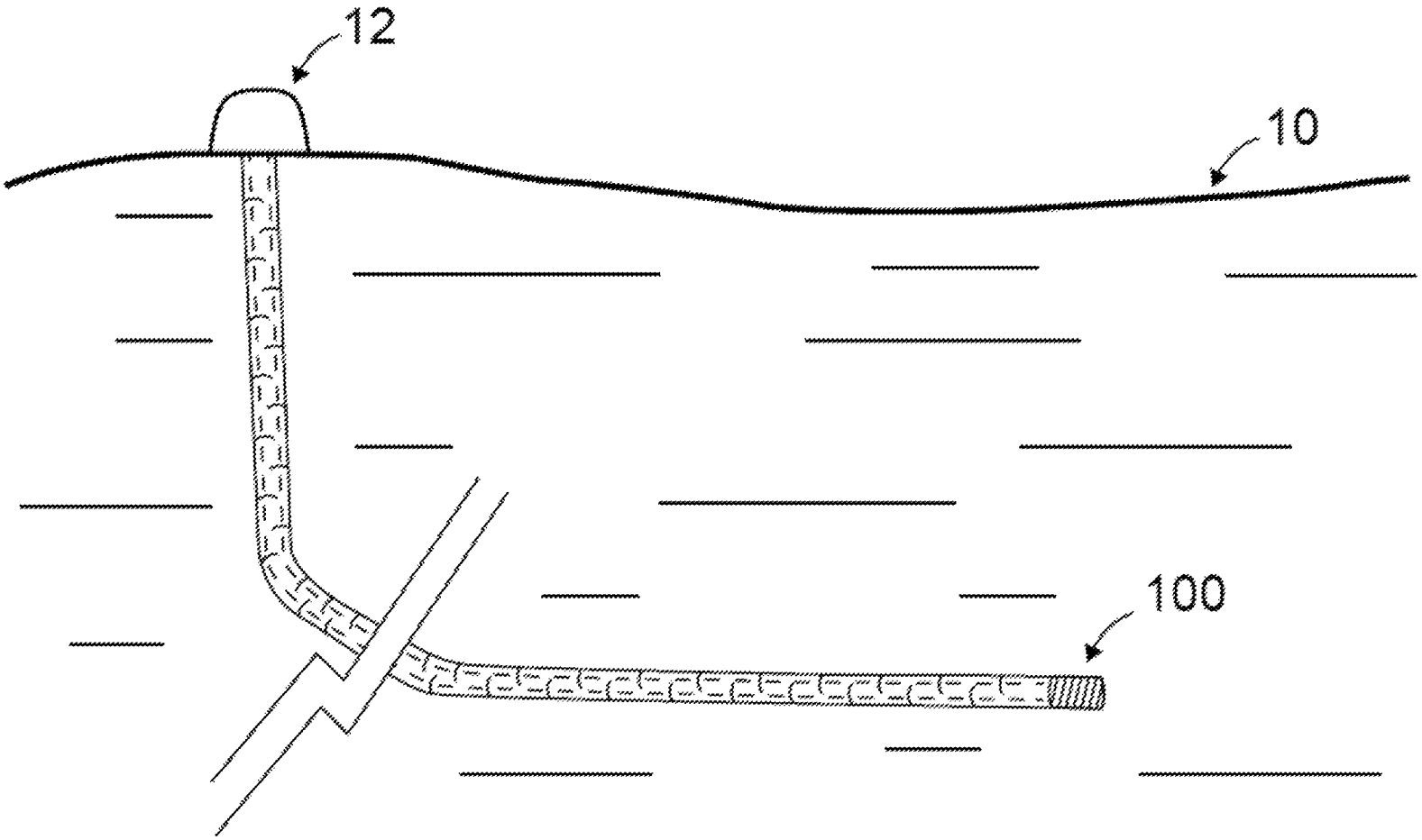

In a newly envisaged seafloor drilling system, a highly automated Active Bottom Hole Assembly (ABHA) 103 which in preference is located on the seafloor 10 (FIG. 1*a*) near the well head by means of an umbilical 109. FIG. 1 shows the ABHA disposed in a forward well position 114, indicated by dashed lines. The seafloor site contains storage and communicating apparatus 12 (FIG. 1*a*, not described here in detail) that controls and powers the drilling and inserts wellbore liner and other downhole equipment along the umbilical 109 that carries insertion infrastructure, power, communications, and control systems. Inserting new liners that are suitable for the particular location in the well bore to be lined can be done from a magazine near the wellhead that has liner selection capability and automatic loading after following selection.

The ABHA provides drilling capability and will host downhole technology for both drilling and assisting with placement of well bore liners. ABHAs are fully steerable and highly maneuverable, and contain automated and controlled robotic apparatus. Drilling, which extends the well forward is preferentially carried out to leave little open hole between completed lining and the well face. Each successive liner in turn is carried down the well by a mechanical or hydraulic carrier system 112 and added near the face in turn as the well is lengthened (120, 122, 124 in sequence). In aspects, the liners are carried down the well in a collapsed state and then allow or caused to expand when moved into position near the face to contact the reservoir strata. The most recently added liner section will always be nearest the face of the well. Automated systems are used to insure correct liner section connection and locking with the up-well section that had been previously set.

A benefit of placing well bore liners in this fashion is that each can be placed very securely, with outward pressure or very close fitting to the reservoir strata so that there is no slip between liners and the walls of the well, as there must be in traditional well casing to allow it to be extended. This resolves the issue of loose fitting casing that requires cementing to secure tight fits to mitigate the potential for blow-by of natural gas and fluids between the outer wall of the liner and the reservoir. Tight-fitting well bore liners fitted as the well is driven, without any requirement to slip the casing forward, overcomes the problem of leakage and blow-by of gas and fluids that can lead to a well blowout.

Figure 2A:
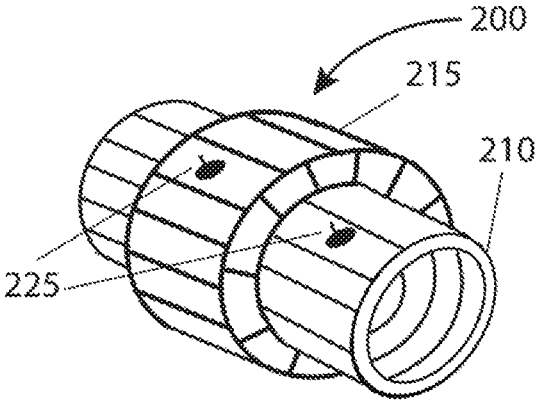
FIG. 2*a* is a diagram of a foamed well liner in accordance with an embodiment of the present invention, showing an inner compartment in which the shape of the interior and exterior is about the same, and an outer compartment where the inner shape is conformal with the inner compartment while its external form is not everywhere conformal with its interior form.
Figure 2B:
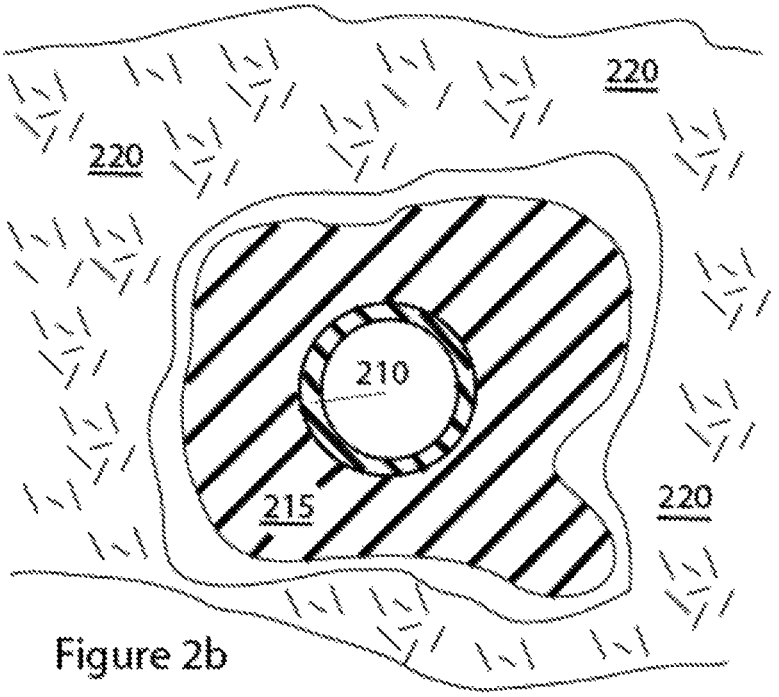
FIG. 2*b* is a diagram of a foamed liner in accordance with an embodiment of the present invention, showing concentric interior and outer walls of an inner compartment and outer compartment with conformal inner wall and outer wall fitting with irregularities of a bounding formation.

With reference to FIGS. 2*a* and 2*b*, liners are foamed in place, while they are positioned from the carrier system to form a continuous pipe-like shape. Foaming is the general term given to an essentially structurally solid, impermeable material formed from admixing two or more materials that undergo chemical reaction and increase their volume. Gas produced by the reaction is relatively equally distributed throughout the solid framework polymer. The material can be porous but impermeable. When foaming is carried out into a mold, a structural solid, such as a pipe-like liner or other space-filling form is produced. Molds are mainly flexible but can have inflexible plates or sections. The shape of the mold is maintained by a web of connecting fabric connecting the interior of the internal wall of the mold to an external or intermediate member that will allow a foamed mold to have a predetermined shape.

Foaming processes are used commonly to fill enclosed space, as in the case of a foamed Styrofoam insulation in a building or into a preformed flexible mold. Foaming agents can be selected for their product characteristics. For instance, the polymer can be dense, solid, not very flexible, and mechanically strong and resilient, or softer and more flexible. A polymer for a well liner section can be designed to meet mechanical requirements.

FIG. 2*a* shows perspective diagram of a compound liner 200 that has an essentially pipe-like interior section 210 having constant width and an exterior belt section 215. The exterior belt section 215 is shown with constant or uniform thickness here for positional simplicity. In practice, however, the exterior of the exterior belt section 215 may have a form determined at least in part by the walls of the bounding sediments 220, as illustrated in FIG. 2*b*.

Internal fabric stringers (not shown) are used between the inner and outer fabric walls of the interior section 210 such that the mold will have a constant wall thickness when foamed. Foaming fills the available space and produce a liner with much the same physical shape as conventional steel casing, with a consistent thickness of liner walls. One or more pressure restricted overflow valves 225 allow for foaming material to exit the exterior of the interior section 210 so that it can occupy the space between the pipe section and the bounding sediments, which results in structurally strong positioning. Where a large volume of excess foam is produced, the foam is forced into the sediment under pressure, which has the same effect as conventionally cemented casing. An additional overflow valve 225 may also be affixed to the exterior belt section 215. Where the wellbore is not highly irregular, the pipe-like liner may not require an external section. Where foaming protrudes outward, for instance along geological strata, weaknesses, keying with sediments will be strongly enhanced. In contrast to conventional casing, liners can have different internal and external shapes and enhanced overall stability and strength achieved entirely while setting each liner. Also, because the liners are formed in place, they do not have to have the strength of a conventional casing and can be engineered to be only as thick as they need to be to maintain well integrity during production. Pipe-only sections may be thinner than conventional casing and relatively less expensive.

Provision for cooling of the exterior of a foamed liner may be necessary in a NGH-enriched section as the foaming polymer process is usually exothermic. This can be important if in NGH-enriched sections because unwanted conversion can take place, which can raise formation pressure. The reaction rate and heat production can often be tailored chemically or by the circulation of cold seawater so unwanted dissociation of NGH can be avoided. Gas produced by thermal conversion will reform NGH as it cools, lowering pressure and increasing sediment strength. Heat transfer from the outside of the liner where conversion is possible to the inner walls that are cooled by circulating cold water in the well, can be assisted by the use of thin wire or meshes of high thermal conductive polymer or metal.

Where overlapping of sections, which are preformed to have fit tightly and to provide a seal between sections will form a type of tight compression joint even if no other forms of sealants are used. Provision is made for the two liner sections to lap, with one end of each section being narrower diameter such that one slides into another and when the newer is foamed, it forces itself into a locking position by forming an overlapping ridged lap joint. This prevents separation later, even with considerable distortion, for instance from sediment compaction.

In general, well bore diameter can be maintained for the entire length of a well if desired. Where it is necessary to line parts of the well bore that are larger and smaller, and neck in or out from the general diameter, or where they are set in such a way to protect or encase equipment within the well, different liners are supplied from a selectable stock that is part of the drilling equipment. In addition to lining a wellbore with either porous or impermeable section, it is possible to foam sections to achieve an in-situ equivalent of cementing casing to lock it firmly into the strata in which the well has been drilled and to prevent leakage as well as forming filtering equipment such as well screens and gravel packs.

In conventional drilling circumstances, cementing the casing to geological formations is used to isolate the pay zone so that pressurized gas, oil or water does not migrate along the outside of the casing/liner into another formation or blow out at the wellhead or elsewhere on the seafloor. Isolating pay zones or producing horizons is one of the critical factors of efficient and safe conventional production. Wherever the well section passes into or out of a having a permeable well section, liners can be sealed tightly against the bounding strata by additional injection of foamed polymer to minimize the risk of leakage.

In pay zones, which term refers to the zone of NGH mineralization from which natural gas will be sourced, the formation may develop a tendency to compact as NGH is converted and the gas produced. Weakening of the during NGH conversion is understood to be a risk. Where volume change or movement of the well or the sediments surrounding it is anticipated, a sinuous well bore can be driven and lined so that it will have the flexibility to move and adapt to sediment movements that may include local faulting without fracturing.

In a payzone, or any other section in which fluid flow through the well liner is desired, the internal pipe section 210 is foamed in a mold that makes it permeable. The simplest embodiment is for larger holes similar to perforations in steel casing that are initiated as one of the last steps of preparation for production. Because the interior section of a compound liner can be formed in place, however, a larger and more complex analog for geometric shapes can be engineered into the molds to allow for a much greater permeability. The thickness of the inner or supporting pipe section can also be foamed in a mold having greater thickness to increase its strength. The inner profile of the wellbore liner can remain conformal with the normal impermeable liner sections in the well, or it can be sized and shaped differently, depending on desired effects on fluid dynamics that extend from within the well to within the nearby reservoir payzone.

A major issue for the continuous and controlled production of natural gas is to control sand flow into the well and minimize the amount of small particulate material that may be produced along with the pay gas. Slowing the gas and especially the accompanying water flow toward the producing well's payzone(s) and maximizing the surface region of the well in the payzone will have the effect of reducing the carrying or fetch of the fluid flowing toward the well, which is a natural result a result of depressurization within the well that also causes conversion of the NGH from its solid form to its constituent gas and water.

Foaming complex shapes in place in the well wall can be used to overcome present difficulties and limitations of implementing conventional techniques for controlling fluid flow in an NGH well, particularly into sub-horizontal sections. These conventional techniques consist of inserting 'gravel packs', which are literally gravel sized clasts inserted adjacent to and/or within the well, and 'sand screens', which are screens, usually fabricated from metal, which are inserted into the well, to produce the desired effects on fluid flow.

In a gravel pack foamed section, which is implemented in the exterior or belt of a compound liner (FIG. 2*a*), which in cross-section is a complexly shaped 'rubbly' zone in which complex permeability paths are established for some distance outward from, the equivalent to a gravel pack can be foamed in place. In cross-section, a compound payzone liner will have an essentially a circular interior wall and an outer zone of any desired thickness and permeability.

Pseudomorphs of gravel in a gravel pack can be foamed with gravel clast forms fed from small tubes connected with a foaming distribution channels (not shown). Small tubes and the foamed gravel pseudomorphs can have very complex shapes that can be engineered to optimize fluid dynamics during production. The mold can be designed to optimize desired fluid flow conditions. For instance, the size of the pseudo-clasts can be varied within the pseudo-gravel pack belt (FIG. 2*b*) and located as desired to meet particular conditions within wells. Because these pseudo-gravel packs can be formed in place, rather than having to be transported down the well as solid clasts and inserted, foamed gravel packs can be volumetrically larger and more exactly engineered and implemented. When a pseudo-gravel pack mold is fully expanded with foamed polymer, the effect of product gas and water passing through it will be to slow fluid passage and reduce the fetch of the moving water can be optimized.

Permeability can be engineered to well size, pressure differentials, and local geology. Foamed sections can be volumetrically symmetrical or asymmetrical with respect to the axis of its interior pipe section, for instance where some directionality in fluid flow is desired and where flow across less permeable zones containing finer grained material can be minimized. The use of compound liners can be used to maximizing production flow within the more permeable reservoir host sediments.

Where a finer porosity sand screen analog is desired, this also can be created in two ways. First, fabric thread mats and 3D meshwork can be fabricated so that when in place they can be tensioned by the expansion of an open gridwork of foam injection tubes. Second, the meshwork can be formed from fine meshwork tubing that is predominately foamed. By using narrow bore pipe lets, a wide variety of filters can be created from the mats. When foamed, and engineered high porosity and a profusion of complex-path permeability can be created in-situ. Provision is made for including different shaped mats, ridges, and larger pseudo-clasts to increase both porosity and permeability, as desired to implement particular fluid dynamic solutions.

An advantage of foaming analog gravel pack and sand screen payzone sections will be the relative ease in time saving and materials required to correctly place a gravel pack, especially in a horizontal or inclined well. Using a foamed gravel pack wellbore liner means that much longer sections of production wellbore can be lined in this fashion, which enhances long-term sand production mitigation.

Where very weak wall conditions are encountered in drilling, a special liner in the form of a rigid collar to the ABHA/drill head is formed in the same manner as liners but not attached to them. Collars can be physically moved forward generally with or slightly in advance or behind the drill face. Drilling thus occurs within the liner, which provides an external guide. This has the same effect as casing a hole during drilling, where casing extends along with or slightly ahead of the drill tool face. Well lining continues normally behind the ABHA, although the well diameter may be increased.

A further use of a collar is for drilling well sections or 'rooms' having larger diameter than the face of the drilling tool. After an opening of a desired size is opened by maneuvering the ABHA drilling tool, a collar substantially larger than the drilling tool diameter can be formed. This also can be pushed generally forward. The drilling tool is maneuvered off-well axis to remove material from within the collar to drill a larger diameter face than would be possible if it simply proceeded forward. The collar can also be angled in any desired direction such that drilling can be deviated directionally.

When it is desired that a narrower (such as the normal well diameter) well section be extended forward or downwell from a larger diameter section, the larger collar is abandoned and left in place outside of the lined well. Liners for both narrower to wide and wide to narrow sections are stored at the wellhead with other liners and delivered to the face as necessary. More than one narrower diameter well may proceed generally forward from a larger diameter 'room' and these can be at different directions from each other or generally in the longitudinal direction of the larger well section.

Where overlapping of sections, which are preformed to have fit tightly and to provide a seal between sections will form a type of tight compression joint even if no other form of sealants is used. Provision is made for the two liner sections to lap, with one end of each section being narrower diameter such that one slides into another and when the newer is foamed it forces itself into a locking position by forming an overlapping ridged lap joint. This prevents separation later, even with considerable distortion, for instance from sediment compaction.

There are several ways that foam materials can be brought into place along with the compacted liners. In one embodiment, a connecting pipe system that would use injection components from a tank on the ABHA fed by components supplied along the umbilical, which is recharged from the seafloor site through narrow bore pipes. This embodiment would be favored where the volume of foaming required was greatly in excess of a liner mold volume. In another embodiment, the foaming materials and injecting system can be contained within and be components of each liner. Provision for both systems may be used within the same well.

There are a number of benefits of using active liner systems for NGH drilling and production rather than using conventional practices. First, a geometrically complex wellbore system can be created including varying diameter well sections. Second, wellbore stabilization takes place in immediately association with drilling while providing bonding with adjacent sediments. In addition, full preparation for production can be made as part of the single phase of wellbore lining, including perforations. Because liners can be emplaced during drilling, overall operations are simpler and time to completion has the potential to diminish.

There are a number of advantages to using active system foamed liners. For example, the interior of a lined well can have near-circular section while the exterior can extend well away from what would otherwise also be a near circular trace of a pipe-like form. The regular interior shape allows for predictable flow while an irregular outer form can lock the well solidly in place. In addition to being firmly fitted, liners may also be formed in such a way that the liner not only lines the well, but can host 3D forms that accomplish certain production-related processes, such as gas-water separation.

Further yet, liner sections generally fit tightly with the bounding sediments. These will have the same security of a cemented conventional casing section, with the exception that each injectable liners may be essentially cemented, rather than in a conventional well where a cementing process usually affects a relatively short section of casing or the junction between different diameter pipe stages.

In addition, the diameter of active system foamed liner states do not have to reduce in diameter with depth as do sections of conventional well casing. An active lined well can have a constant diameter for its whole length, which may be greatly in excess of a stage of conventional well casing. In addition, wider diameter sections may be formed, for instance where a sidetrack well is desired and additional maneuvering space for the ABHA is required, or where it is desired to increase the surface area within a payzone to assist control of flow of gas and water into a producing well, or where it is desired to place equipment, such as downhole pumps. In addition, sumps may be formed in downward-plunging side tracks.

Some of the wellbore lining techniques described here, and in conjunction with description of the different manners of drilling a NGH deposit for most efficient gas production, may find application in other hydrocarbon reservoir resources. It is to be understood that their description here using the NGH resource as a primary example, can be applied in part or in the whole to other hydrocarbon resources when physical conditions of those allow (i.e., when their parameters are similar enough for application).

What is claimed is:

1. A system for producing natural gas from a deepwater natural gas hydrate deposit, the system comprising:

a wellhead disposed on a seabed surface;

a wellbore formed in a natural gas hydrate deposit located in a partially consolidated sediment, the wellbore extending from the wellhead to a forward well position at which excavation is being performed; and a continuous string of foam wellbore liners disposed in succession along a length of said wellbore up into the vicinity of, but not completely to, the forward well position, each wellbore liner of said plurality of wellbore liners having been foamed in place during placement in said wellbore and the string of wellbore liners being positioned relative to walls of the wellbore so as to maintain physical integrity of the wellbore and keep the wellbore open even if walls of the wellbore slough off.

2. The system of claim 1, wherein adjacently disposed wellbore liners of said plurality of wellbore liners are sealed to one another by a foam seal created when one of the adjacent wellbore liners is foamed in place.

3. The system of claim 1, wherein one or more wellbore liners of said plurality of wellbore liners includes an overflow valve.

4. The system of claim 1, wherein one or more wellbore liners of said plurality of wellbore liners includes an interior sidewall and exterior sidewall spaced radially outward from said interior sidewall, and wherein said interior sidewall and said exterior sidewall are made of fabric.

5. The system of claim 1, wherein one or more wellbore liners of said plurality of wellbore liners is permeable.

6. The system of claim 1, wherein one or more wellbore liners of said plurality of wellbore liners has an exterior belt made of foam.

7. A method of forming and supporting a wellbore extending from a seafloor surface, comprising the steps of:

using drilling apparatus, drilling a wellbore in a formation of partially consolidated sediment that has a natural gas hydrate deposit and that is located below the seafloor surface, the wellbore extending from a wellhead disposed on the seafloor surface to a forward well position at which excavation is being performed;

as the wellbore is advanced into the formation, sequentially positioning a plurality of individual wellbore liners just behind the drilling apparatus; and foaming in place each wellbore liner as it is positioned in said wellbore so as to form a continuous string of wellbore liners, with the wellbore liners extending along the length of the wellbore into the vicinity of, but not completely to, the forward well position and the string of wellbore liners being positioned relative to walls of the wellbore so as to maintain physical integrity of the wellbore and keep the wellbore open even if walls of the wellbore slough off.

8. The method of claim 7, wherein during the foaming step each wellbore liner is sealed to the previously positioned wellbore liner by a foam seal disposed between the wellbore liners that is created during foaming.

9. The method of claim 7, wherein during said positioning step one or more wellbore liners of said plurality of wellbore liners is positioned in said wellbore in a collapsed state and then expanded to contact said formation.

10. The method of claim 7, wherein during said foaming step an exterior belt of foam is formed around the wellbore liner undergoing foaming.

* * * * *